US007341219B2

(12) United States Patent
Myers et al.

(10) Patent No.: US 7,341,219 B2
(45) Date of Patent: Mar. 11, 2008

(54) PAPER ROLL HOLDER FOR A PRINTER CONVERTIBLE BETWEEN SNAP-IN LOADING AND DROP-IN LOADING OF THE PAPER ROLL

(75) Inventors: Robert Andrew Myers, Cary, NC (US); Jeff David Thomas, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 11 days.

(21) Appl. No.: 11/503,869

(22) Filed: Aug. 11, 2006

(65) Prior Publication Data

US 2007/0034729 A1 Feb. 15, 2007

Related U.S. Application Data

(62) Division of application No. 10/800,835, filed on Mar. 15, 2004, now Pat. No. 7,108,221.

(51) Int. Cl.
*B65H 16/06* (2006.01)

(52) U.S. Cl. ..... 242/596.7; 400/613

(58) Field of Classification Search ..... 242/596.3, 242/596.7, 596.8; 400/613
See application file for complete search history.

(56) References Cited

U.S. PATENT DOCUMENTS

| | | | |
|---|---|---|---|
| 1,402,167 | A | 2/1922 | Kingsbury |
| 1,778,282 | A | 10/1930 | Stewart |
| 2,555,885 | A | 6/1951 | Hope |
| 4,479,615 | A | 10/1984 | Nakajima et al. |
| 4,614,312 | A | 9/1986 | Del Pino |
| 4,821,974 | A | 4/1989 | Poehlein |
| 5,060,877 | A | 10/1991 | Bullivant |
| 6,503,008 | B2 | 1/2003 | Zevin et al. |
| 6,536,696 | B2 | 3/2003 | Fiutak et al. |

*Primary Examiner*—John Q. Nguyen
(74) *Attorney, Agent, or Firm*—Jason O. Piche

(57) ABSTRACT

A printer using a paper supply roll is provided with a capability for conversion between snap-in loading of the paper roll, in which the roll is snapped into place with the tubular core of the paper roll being held to rotate between a pair of bearing members, and drop-in loading, in which the roll is dropped onto a support surface, against which the periphery of the roll then turns. In a first version, each of the bearing members has a flat side and a spherical side, which is turned inward for snap-in loading and outward for drop-in loading. In another version, the bearing members are moved inward for snap-in loading and outward for drop-in loading.

6 Claims, 3 Drawing Sheets

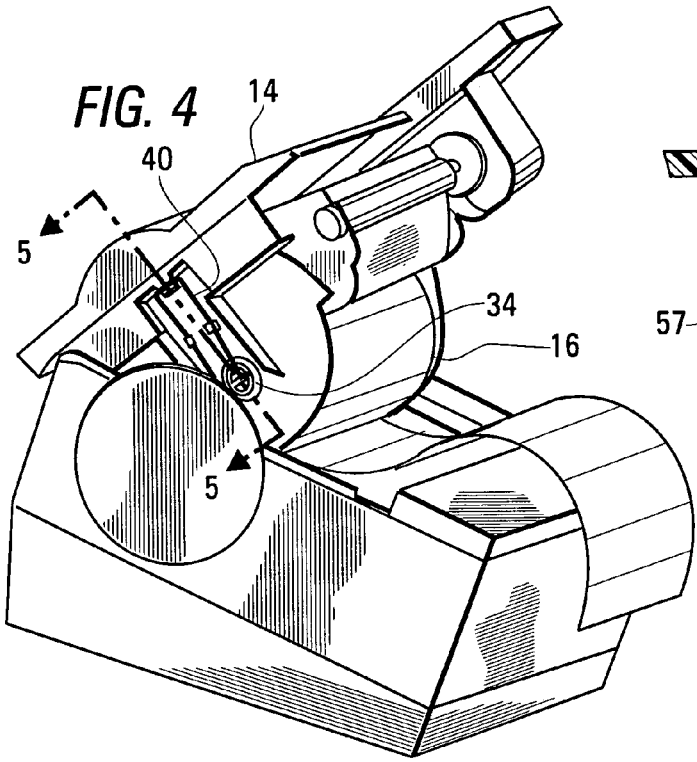
FIG. 4
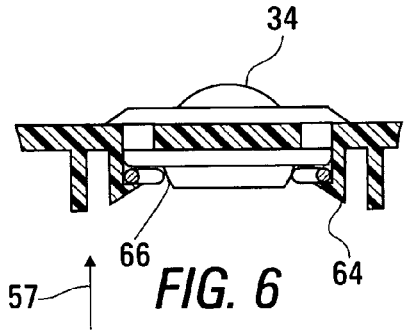
FIG. 6
FIG. 5
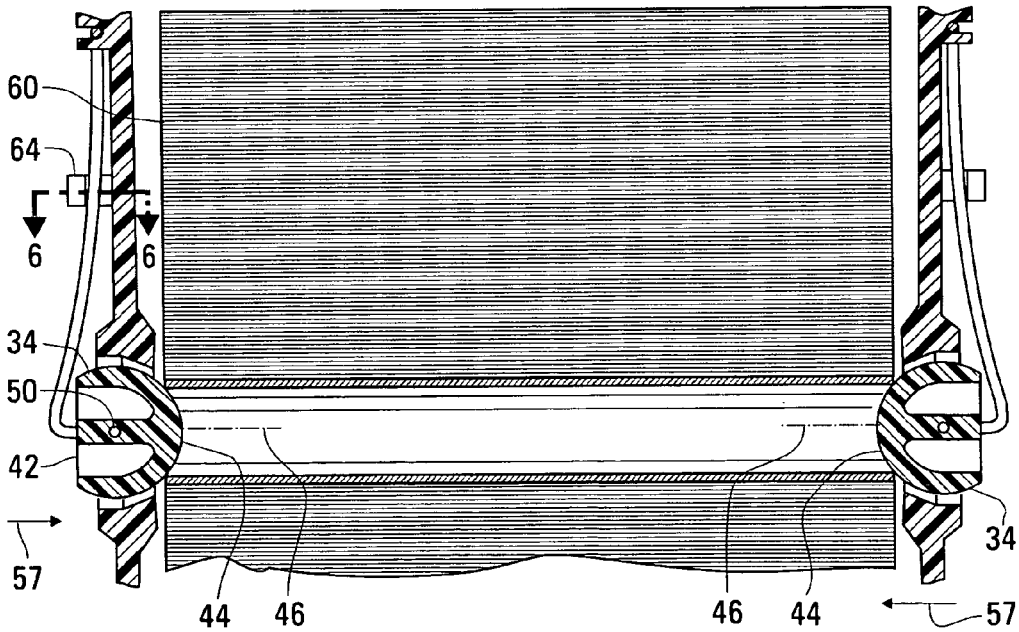

PAPER ROLL HOLDER FOR A PRINTER CONVERTIBLE BETWEEN SNAP-IN LOADING AND DROP-IN LOADING OF THE PAPER ROLL

CROSS-REFERENCE TO A RELATED APPLICATION

This is a division of U.S. patent application Ser. No. 10/800,835, filed on Mar. 15, 2004, now U.S. Pat. No. 7,108,221 for which a Notice of Allowance has been received.

BACKGROUND OF THE INVENTION

1. Field of the Invention

This invention relates to a paper roll holder for a printer, and, more particularly, to a mechanism allowing the paper roll to be either snapped into place between bearing members or dropped into place within the holder.

2. Summary of the Background Art

Many printers, especially the small point-of-sale printers used to generate sales receipts, use roll paper to achieve the advantages of easy loading, reliable feeding, and of an ability to generate receipts that vary greatly from one another in length. Some such printers provide for snap-in loading of the paper roll, in which a cylindrical center portion of the paper roll is held to rotate between a pair of spring-loaded bearing members. Other such printers provide for drop-in loading, in which the paper roll is dropped into a cavity or bucket that holds the roll by its periphery as the roll rotates. As paper is pulled from the roll during the printing process, the roll rotates within the cavity, being supported by rollers or by a curved surface within the cavity.

A printer configured for holding a snap-in paper roll is described, for example, in U.S. Pat. No. 6,536,606, with the paper roll being held between two inwardly spring loaded spherical bearing members. Spring loaded bearing members having spherical contact surfaces are also used in other applications, such as holding toilet paper or paper toweling, as described in U.S. Pat. No. 4,614,312, and for holding a roll of photographic film within a camera, as described in U.S. Pat. No. 1,402,167. Within a printing device or copier, a paper roll having a cylindrical core may alternately be held by means of spring loaded bearing members having truncated conical surfaces, as described in U.S. Pat. No. 4,821,974, or a paper roll may be held between flanges mounted on a shaft having tapered shafts fitting into cup-shaped holders as described in U.S. Pat. No. 4,821,974. Spring-loading may be accomplished by placing springs at each of the bearing members or at only one of the bearing members. Spherical bearing members have an advantage of allowing the roll to be snapped into place with a straight movement into the holder, with the use of springs at both ends reducing the amount of movement required and centering the paper roll.

U.S. Pat. No. 5,060,877 describes an automatic version of drop-in loading, in which the paper roll, having been dropped into place atop rollers within a cavity, is caused to rotate by spinning the rollers, so that the end paper web is automatically fed into a channel from the roll.

Some users of point-of-sale printers prefer drop-in paper roll loading, because of its inherent simplicity and because of the speed with which it can be accomplished. Other users favor snap-in loading because the paper roll is aligned more accurately within the printer. Therefore, what is needed is a paper roll holder that can be easily converted between snap-in loading and drop-in loading.

SUMMARY OF THE INVENTION

According to one aspect of the invention, apparatus is provided for rotatably holding a paper supply roll, having a cylindrical peripheral surface and a hollow cylindrical core, within a printer. The apparatus includes a lower support surface for engaging the peripheral surface of the paper supply roll, a cavity for holding the paper supply roll, extending within the printer above the lower support surface, a pair of spaced-apart side plates disposed within the cavity, and a pair of bearing members. Each of the side plates includes a mounting structure having a tubular portion extending outward from the side plate, with a slot extending inward. Each of the bearing members is held within one of the mounting structures, with the bearing members being held within axial alignment of one another. Each of the bearing members includes a tapered surface for engaging the hollow cylindrical core and a shoulder having a tab. Each of the bearing members is mounted to be moved between an inward position, having the tapered surface of the bearing member facing inward within a space between the side plates and disposed within the space between the side plates, and having the tab extending inward within the slot in the tubular portion, and an outward position, having the tapered surface of the bearing member facing inward and held out of the space between the side plates, and having the tab held against an outer surface of the tubular portion. Each of the bearing members is held in the inward position and in the outward position.

Preferably, the apparatus additionally includes a pair of springs, with each of the springs pushing one of the bearing members inward. Preferably, each of the bearing structures additionally includes a lever for rotating the bearing member within the mounting structure between the inward and outward positions.

BRIEF DESCRIPTION OF THE DRAWINGS

FIG. 4 is a perspective view of the receipt printer of FIG. 1, configured to provide for snap-in loading;

FIG. 5 is a fragmentary cross-sectional view of the receipt printer as shown in FIG. 4, taken as indicated by section-line 5-5 therein;

FIG. 6 is a fragmentary cross-sectional view of the receipt printer as shown in FIG. 4, taken as indicated by sections-line 6-6 in FIG. 5;

DETAILED DESCRIPTION OF THE INVENTION

Figure 1:
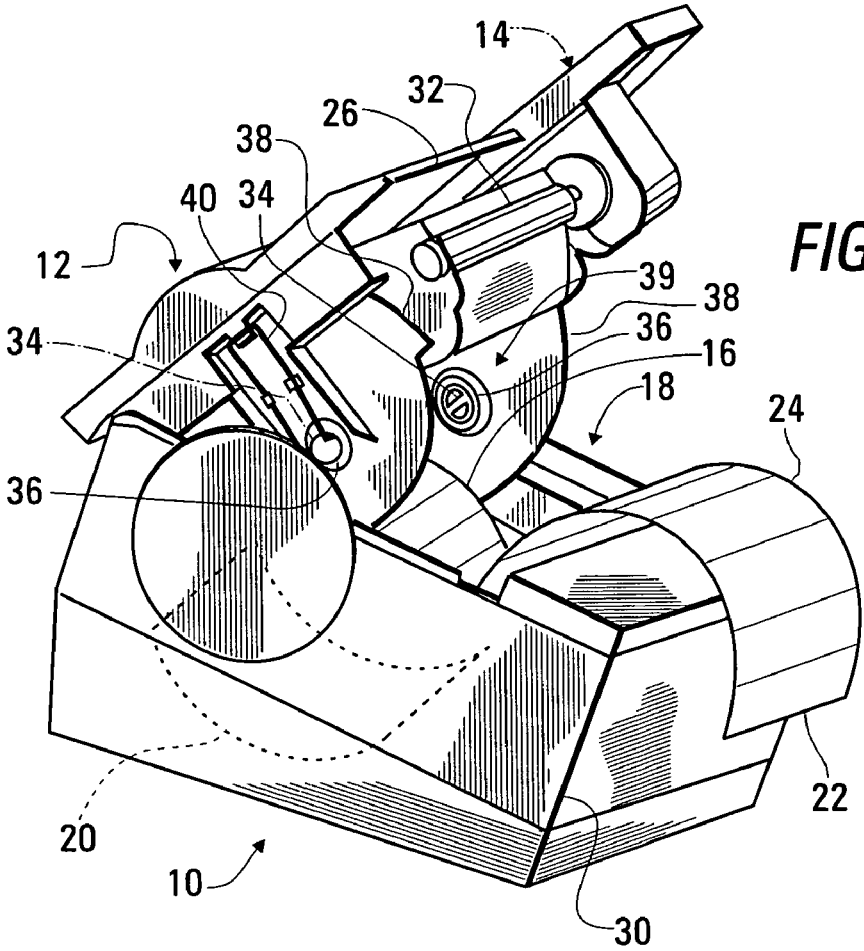
FIG. 1 is a perspective view of a receipt printer including a paper roll holder built in accordance with a first embodiment of the invention, configured to provide for drop-in loading.

FIG. 1 is a perspective view of a receipt printer 10 including a paper roll holder 12 built in accordance with a first embodiment of the invention and configured to provide for drop-in loading of a paper supply roll. The receipt printer 10 is shown as opened, with an upper cover 14 pivoted upward for paper loading, having received a paper supply roll 16. The paper roll 16 has been dropped into a cavity 18 to rest on a curved lower support structure 20, extending below the cavity 18 within the receipt printer 10. During the paper loading process, the outer end 22 of the paper web 24 forming the roll 16 is pulled outward so that the web 24 extends through a slot formed between a front cover surface 26 of the upper cover 14 and an adjacent surface 28 of the printer housing 30. When the upper cover 14 is then closed, the paper web 24 passing by a printing mechanism (not shown) and a drive roller 32 that is rotated to move the paper through the printing process.

The paper roll holder 12 includes a pair of bearing members 34 held within holes 36 extending through side plates 38 that pivot with the upper cover 14. Each of the bearing members is spring loaded inward, toward the space 39 between the side plates 38, by a bearing member mounting structure formed as a wire spring 40. While only one of the wire spring mounting structures 40 is visible in the figure, it is understood that each of the bearing members 34 is held inward by a corresponding wire spring mounting structure 40. (The specification herein of an "inward" direction means toward the center of the space 39 between the side plates 38, regardless of which of the two bearing members 34 is being discussed, while an "outward" direction is opposite to the "inward" direction.)

Figure 2:
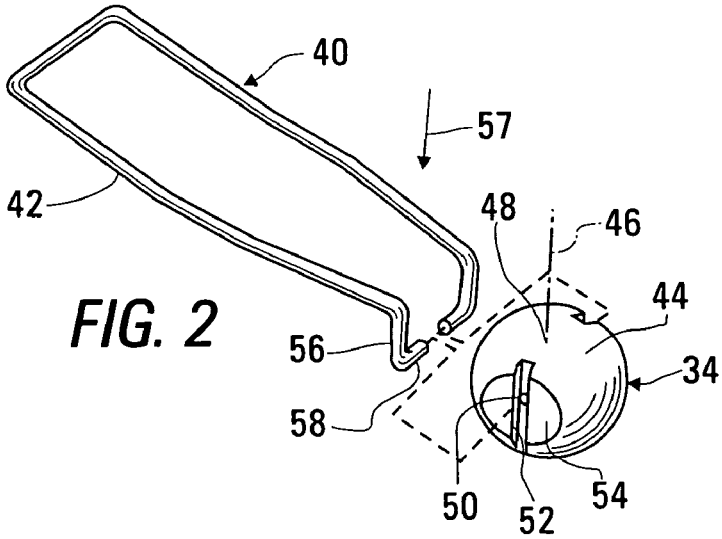
FIG. 2 is a perspective view of a spring within the paper roll holder of FIG. 1, shown in an exploded relationship with a bearing member used therein.
Figure 3:
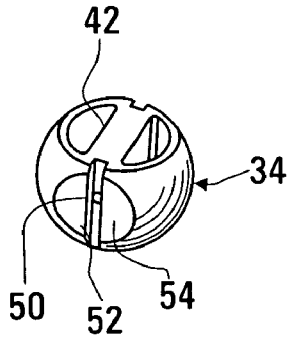
FIG. 3 is a perspective view of the bearing member of FIG. 2, oriented to show a flat side thereof.

The characteristics of the wire spring mounting structure 40 and the bearing member 34 will now be discussed with particular reference being made to FIGS. 2 and 3. FIG. 2 is a perspective view of the wire spring mounting structure 40 in an exploded relationship with the bearing member 34, while FIG. 3 is a perspective view of the bearing member 34 rotated so that a flat surface 42 thereof is visible.

Each of the bearing members 34 includes a tapered surface 44 that extends from an axis 46 of the bearing member, with the tapered surface 44 increasing in diameter with movement along the tapered surface 44 away from an intersection 48 of the tapered surface 44 and the axis 46. For example, the tapered surface 44 is formed as a portion of a sphere. The tapered surface 44 extends along the bearing member 34 opposite the flat surface 42. Each of the bearing members 44 also includes a hole 50, extending through the bearing member 44, within parallel slots 52 extending along partly-flattened opposite sides 54 of the bearing member 44. The parallel slots 52 extend perpendicular to the flat side 42 of the bearing member.

The wire spring mounting structure 40 includes a U-shaped portion 42 from which a pair of legs 56 extend inward, in the direction of arrow 57, toward the space 39 between the side plates 38, when the spring mounting structure 40 is held in place on either of the two side plates 38. An end portion 58 of the spring mounting structure 40 extends from the end of each of the legs 56.

The bearing member 34 is assembled to the wire spring mounting structure 40 by spreading the end portions 58 so that they can fit into opposite sides of the hole 50 extending through the bearing member 34. The end portions 58 are then brought toward one another within the hole 50 so that the legs 56 extend within the slots 52 at each side of the bearing member 34. As this is done, the bearing member 34 may be oriented as shown in FIGS. 1 and 2, with the flat side 42 thereof facing inward, in the direction of arrow 57, and with the tapered surface 44 facing outward, opposite the direction of arrow 57. This orientation places the bearing member 34 in an outward position, with the tapered surface 44 being held out of the space 39 between the side plates 38, providing for drop-in loading of the paper supply roll 16, which, upon being installed within the cavity 18, comes to rest against the lower support surface 20 without being stopped by engagement with one of the tapered surfaces 44. The space 39 is wider than the paper roll 16 to be inserted.

FIGS. 4 and 5 show the printer 10 configured to provide for snap-in loading of the paper supply roll 16, with FIG. 4 being a perspective view thereof, and with FIG. 5 being a fragmentary cross-sectional view thereof, taken as indicated by section lines 5-5 in FIG. 4. In FIG. 4, the receipt printer 10 is shown as opened, with the upper cover 14 pivoted upward for paper loading, having received the paper supply roll 16 to be held between the two bearing members 34.

To provide for snap-in loading of the paper roll, each of the bearing members 34 is held within a corresponding wire spring mounting structure 40 so that, when the wire spring mounting structure 40 is installed to extend along the corresponding side plate 38, the tapered surface 44 of the bearing member 34 faces inward, in the direction of arrow 57, while the flat surface 42 of the bearing member 34 faces outward, opposite the direction of arrow 57. As the paper supply roll 16 is moved into place between the two side plates, end surfaces 60 of the roll 16 contact the tapered surface 44, of each of the bearing members 34, forcing the bearing members 34 to move outward, opposite the corresponding direction of arrow 57. As the paper supply roll 16 is fully installed, the tapered surfaces 44 of the bearing members 34 move into a hollow cylindrical core 62 of the paper supply roll 16, allowing the paper supply roll 16 to be snapped into place with the hollow cylindrical core 62 extending between the bearing support members 34.

FIG. 6 is a fragmentary cross-sectional view of the receipt printer 10, taken as indicated by section lines 6-6 in FIG. 5, particularly showing a pair of hook-shaped structures 64 holding each of the wire spring mounting structures 40 so against opposite sides 66 of the bearing member 34 and additionally holding the spring wire mounting structure 40 to push the bearing member 34 inward, in the direction of arrow 57.

Figure 7:
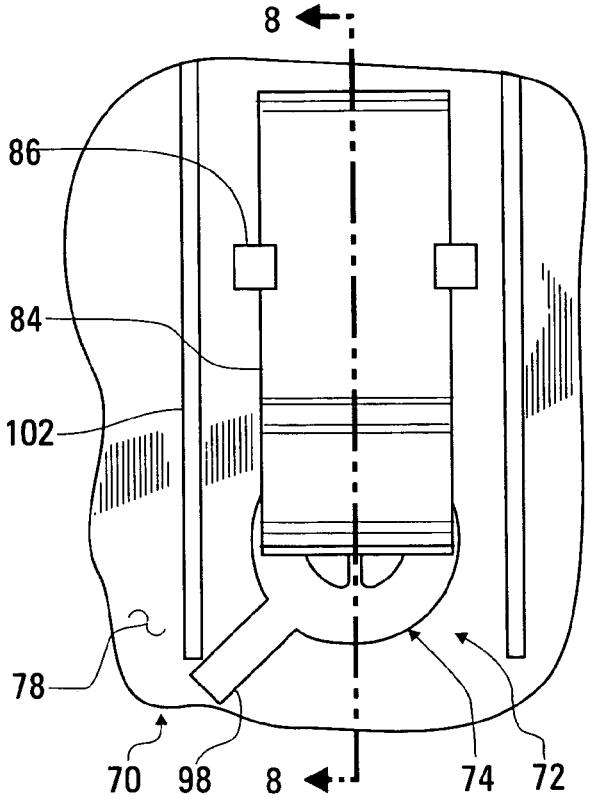
FIG. 7 is a fragmentary side elevation of a receipt printer showing a roll paper holder built in accordance with a second embodiment of the invention.
Figure 8:
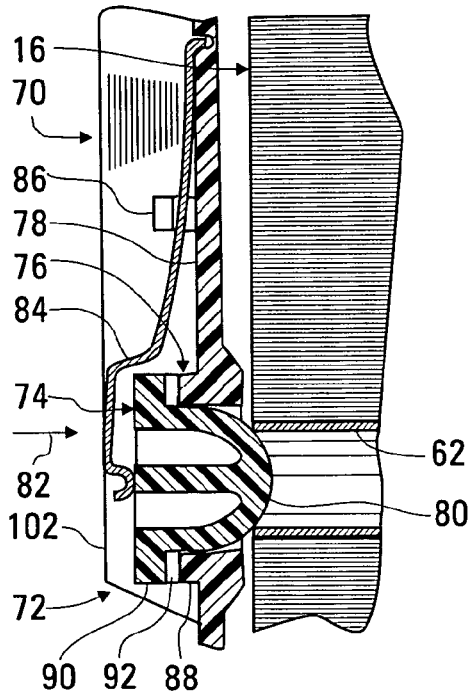
FIG. 8 is a fragmentary cross-sectional view of the receipt printer of FIG. 7, taken as indicated by section line 8-8 therein.
Figure 9:
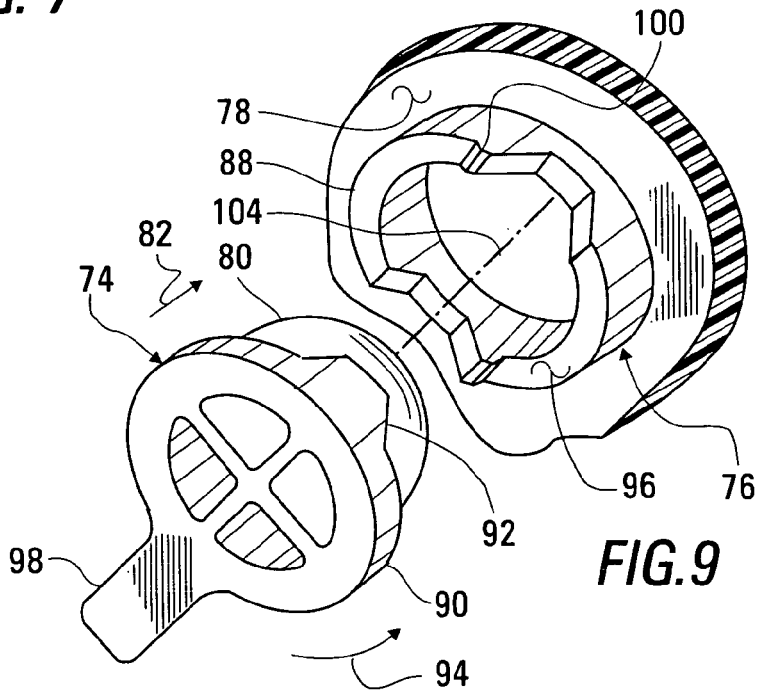
FIG. 9 is a perspective view of a bearing member within the receipt printer of FIG. 7, shown in an exploded relationship with a mounting structure of a side plate within the printer, in which the bearing member is mounted.

A second embodiment of the invention will now be discussed with particular reference being made to FIGS. 7-9. FIG. 7 is a fragmentary side elevation of a receipt printer 70 showing a roll paper holder 72 built in accordance with a second embodiment of the invention. FIG. 8 is a fragmentary cross-sectional view of the receipt printer 70, taken as indicated by section line 8-8 in FIG. 7. FIG. 9 is a perspective view of a bearing member 74 for holding the paper supply roll 16 within the receipt printer 70, shown in an exploded relationship with a mounting structure 76 of one of the two side plates 78 within the printer 70, in which the bearing member 74 is mounted.

In FIG. 8, the bearing member 74 is shown in an inward position, with a tapered surface 80 of the bearing member 74 extending into the hollow cylindrical core 62 of the supply paper roll 16, so that the supply paper roll 16 is rotatably mounted between the tapered surfaces 80 of two bearing members 74 on opposite sides of the paper supply roll 16.

Again, the tapered surfaces 80 may be portions of spheres, as shown, or, for example, truncated cones. In a manner similar to that described above in reference to FIG. 6, this configuration provides for snap-in loading of the paper roll 16. The bearing member 74 is held inward, in the direction of arrow 82 by a leaf spring 84 extending along the surface of the side plate 78, being held in place by a pair of L-shaped structures 86.

As shown particularly in FIG. 9, the bearing member 74 is slidably and pivotably mounted within a tubular portion 88 of the mounting structure 76. The bearing member 74 includes a shoulder 90 having a pair of tabs 92 extending into a pair of slots 93 within the tubular portion 88 when the bearing member 74 is held in its inward position. As shown in FIG. 8, a space 94 is formed between the shoulder 90 and the tubular portion 88, with the bearing member 74 in its inward position, when the paper roll 16 engages the tapered surface 80 of the bearing member.

The bearing member 74 is brought into its outward position by being pivoted in the direction of arrow 95 so that the tabs 92 of the shoulder 90 rest on the raised surface 96 of the tubular portion 88, holding the bearing member 74 outward. A lever 98 is provided to facilitate the manual pivoting of the bearing member 74 in and opposite the direction of arrow 94, between inward and outward positions. A detent bump 100 may be added to prevent inadvertent movement of the bearing member 74 from its outward position to its inward position. The movement of the lever 102 is further limited by contact with ribs 102 disposed in the side plate 78 at opposite sides of the mounting structure 76.

While only one bearing member 74 has been shown and discussed in detail, it is understood that this bearing member 74 is exemplary of the two bearing members 74 mounted at opposite sides of the space provided for the paper roll 16 within the receipt printer 70. Each of the two bearing members 70 has an axis 104, about which rotation of the bearing member 74 occurs within the tubular portion 88, with these two axes 104 being aligned with each other.

While the invention has been described in its preferred embodiments with some degree of particularity, it is understood that this description has been given only by way of example, and that many variations in the form and combination of parts may be made without departing from the spirit and scope of the invention, as defined in the appended claims.

What is claimed is:

1. Apparatus for rotatably holding a paper supply roll, having a cylindrical peripheral surface and a hollow cylindrical core, within a printer, wherein the apparatus comprises:

a lower support surface for engaging the peripheral surface of the paper supply roll;

a cavity for holding the paper supply roll, extending within the printer above the lower support surface;

a pair of spaced-apart side plates disposed within the cavity, wherein each of the side plates includes a mounting structure having a tubular portion extending outward from the side plate having a slot extending inward;

a bearing member, pivotably and slidably mounted within the tubular portion of each of the mounting structures, wherein the bearing members are held in axial alignment with one another, wherein each of the bearing members includes a tapered surface for engaging the hollow cylindrical core and a shoulder having a tab, wherein each of-the bearing members is mounted to be moved between an inward position, having the tapered surface of the bearing member facing inward within a space between the side plates and disposed within the space between the side plates, and having the tab extending inward within the slot of the tubular portion, and an outward position, having the tapered surface of the bearing member facing inward and held out of the space between the side plates, and having the tab held against an outer surface of the tubular portion, and wherein each of the bearing members is held in the inward position or in the outward position.

2. The apparatus of claim 1, additionally including a pair of springs, wherein each of said springs pushes one of said bearing members inward.

3. The apparatus of claim 1, wherein each said bearing structure additionally includes a lever for rotating said bearing member within said mounting structure between said inward and outward positions.

4. Apparatus for rotatably holding an end of a paper supply roll, having a cylindrical peripheral surface and a hollow cylindrical core, within a printer, wherein the apparatus comprises a bearing member including a tapered surface for engaging the hollow cylindrical core; and a side plate including a mounting structure holding said bearing member in an inward position with the tapered surface engaging the hollow cylindrical core and in an outward position, with said tapered surface held out of engagement with the hollow cylindrical core, wherein said mounting structure includes a tubular portion extending outward from one of said side plates, including a slot extending inward, said bearing member is pivotably and slidably mounted within said tubular portion, said bearing member includes a shoulder having a tab extending inward within the slot of the tubular portion with said bearing member in said inward position, and the tab is held against an outer surface of the tubular portion with said bearing member in said outward position.

5. The apparatus of claim 4, additionally comprising a spring pushing said bearing member inward.

6. The apparatus of claim 4, wherein said bearing structure additionally includes a lever for rotating said bearing member within said mounting structure between said inward and outward positions.

* * * * *